United States Patent [19]

Klahn et al.

[11] Patent Number: 4,804,038

[45] Date of Patent: Feb. 14, 1989

[54] REMOTELY INSTALLED, OPERATED AND REMOVED MANIPULATOR FOR STEAM GENERATOR

[75] Inventors: Francis C. Klahn, Huddleston; Charles E. Werner, Lynchburg; Floyd A. Fasnacht, Jr., Forest, all of Va.

[73] Assignee: The Babcock & Wilcox Company, New Orleans, La.

[21] Appl. No.: 203,612

[22] Filed: Jun. 3, 1988

Related U.S. Application Data

[63] Continuation of Ser. No. 540,221, Oct. 11, 1983, abandoned.

[51] Int. Cl.[4] ..... B25J 9/04

[52] U.S. Cl. ..... 165/11.2; 165/76; 414/728; 414/744.1; 901/15

[58] Field of Search ..... 165/11.2, 76; 414/1, 414/4, 744 R, 744 A, 749, 728; 901/15

[56] References Cited

U.S. PATENT DOCUMENTS

| | | | |
|---|---|---|---|
| 3,964,293 | 6/1976 | Faure et al. | 414/749 |
| 4,205,939 | 6/1980 | Reyes | 165/11 A |
| 4,205,940 | 6/1980 | Golick | 414/728 |
| 4,213,732 | 7/1980 | Cooper, Jr. | 414/744 R |
| 4,216,893 | 8/1980 | Glatthorn | 165/76 |
| 4,302,146 | 11/1981 | Finlayson et al. | 165/76 |
| 4,438,805 | 3/1984 | Gugel | 165/11 A |
| 4,507,044 | 3/1985 | Hutchins et al. | 414/744 R |
| 4,673,027 | 6/1987 | Vermaat | 165/11.2 |

FOREIGN PATENT DOCUMENTS

| | | | |
|---|---|---|---|
| 2852821 | 4/1980 | Fed. Rep. of Germany | 901/15 |

*Primary Examiner*—Albert W. Davis, Jr.
*Assistant Examiner*—John K. Ford
*Attorney, Agent, or Firm*—Robert J. Edwards; Kenneth W. Iles

[57] ABSTRACT

A remotely installed, operated and removed manipulator for steam generator includes a mast, an articulating arm attached to the mast, capable of operating in the bottom or top head of a once through steam generator or the head of a recirculating steam generator. Each embodiment can be remotely installed and removed. The manipulator provides precise access to tubes and can sustain substantial loads, so the apparatus can perform much of the tube work that must be performed inside a steam generator.

6 Claims, 7 Drawing Sheets

REMOTELY INSTALLED, OPERATED AND REMOVED MANIPULATOR FOR STEAM GENERATOR

This application is a continuation of application Ser. No. 540,221 filed Oct. 11, 1983, now abandoned.

BACKGROUND OF THE INVENTION

1. Field of the Invention

The invention relates to an apparatus for remotely repairing the tubes and tubesheet of a steam generator, and more particularly to such an apparatus that can be remotely installed in and removed from a steam generator and which provides for quick change of ancillary devices such as tools.

2. Description of the Prior Art

In a variety of environments it may be highly desirable to provide a platform or carriage from which various types of work can be conducted remotely. Furthermore, it may be necessary to move the work station relative to the surface or member on which the work is being conducted. Space limitations or biological considerations may make it desirable to control such movement remotely. A prime example of this need is presented by a nuclear steam generator, where it may be necessary to inspect or repair some of the tubes inside the steam generator. Normally, these repairs are only required after the steam generator has been operated, which naturally renders the steam generator radioactive. The level of radioactivity within the steam generator may seriously limit the amount of time a man can spend in the environment. In addition, to work in this environment at all a man must wear bulky and heavy protective gear which severely restricts his mobility, vision and stamina. Therefore, it is desirable and sometimes perhaps necessary to provide remotely operable and controllable means for performing the required work.

Numerous prior art devices for performing specialized functions, for example directing an eddy current probe through the tubes, have been developed. One such effort is disclosed in U.S. Pat. No. 3,913,752, issued to Ward et al. on Oct. 21, 1975, which is commonly referred to as a "finger walker" within the industry. Such devices are slow, cumbersome, difficult to control and locate precisely and do not retain a firm hold on the tubesheet. Therefore, they are not capable of carrying heavy loads. In addition, such a manipulator is not capable of operating in the top head of a once through steam generator. Furthermore, such devices must be installed and removed by a person who is inside the hazardous steam generator.

Another such device is disclosed in U.S. Pat. No. 4,216,832 issued Aug. 12, 1982, to Galtthorne. This device also is capable of operating only in the bottom head of a recirculating steam generator. Furthermore, this device and others of its kind are not capable of remote installation in and removal from a nuclear steam generator. A man must go inside the head of the steam generator to install the device and to remove it.

Although the time required for installation and removal of the device is less than would be required for a man to enter the steam generator and actually perform the required work, many of the disadvantages of having a man work inside the steam generator still arise because he must be available to install and later remove the device, with the consequent exposure to radiation this entails. Radiation levels inside a nuclear steam generator are two to three times higher than those outside it, even when emissions from the manway are included in outside radiation measurement. Thus a remotely installed and removed apparatus would substantially reduce radiation burn out of jumpers, lowering labor costs and reducing personnel needs.

One effort to overcome this difficulty is disclosed in general terms in European patent application publication No. 0 066 791 published on Dec. 15, 1982 invented by Vermaat. In Vermaat, the top of the supporting pole is detachably connected to a mounting rod which extends outside the access port of the steam generator, commonly referred to as a manway, and is held by a man who guides an anchor pin into the tubesheet. The main arm is then guided through the manway on a channel rail and attached to the bottom of the supporting pole. From this position, the main arm is moved up the supporting pole to the work position. In a second embodiment, the apparatus is previously assembled with the main arm being already attached to the supporting pole. In this case, it is not necessary that the main arm be run into the steam generator on the channel rail. Still, however, a man must lift the apparatus to the top of the head of the steam generator, locate the locator tubes and install the anchor pins in the appropriate tubes. The tubes of a nuclear steam generator are typically $\frac{5}{8}''$ in diameter and are closely packed. It is essential that the anchor pins be located in the correct tubes; otherwise the device will not know where its tool is located. The apparatus weighs in excess of 100 pounds and must be raised approximately five feet by a man who is laterally removed from the apparatus by three or four feet. In addition, the man must wear protective clothing to shield him from the radiation emanating from the manway. Thus, installation of this apparatus in either embodiment is a skilled operation requiring great strength combined with considerable dexterity. In addition, the apparatus is capable of operation only in the head of a recirculating steam generator.

Therefore, a need exists for an apparatus which can be remotely installed and removed from a steam generator, which can be operated in a recirculating steam generator, or in the top or bottom head of a once through steam generator, which is capable of reaching nearly all the tubes of a recirculating steam generator or a once through steam generator from one location, and which can reach all tubes of a once through steam generator with one change of position and which is capable of performing a variety of operations with a variety of tools that can be quickly changed while maintaining the ability to locate any individual tube with any individual tool and which accordingly is capable of sustaining high loads and forces without substantial deflection.

SUMMARY OF THE INVENTION

It is an object and an achievement of the present invention to provide an apparatus that can be installed and removed from a steam generator without having a man enter the steam generator, that is, remotely.

It is another object of the invention to provide an apparatus capable of working in either a once through steam generator or a recirculating steam generator.

It is another object of the present invention to provide an apparatus that can operate in the top head of a once through steam generator.

It is a another object of the present invention to provide an apparatus capable of reaching all tubes in either the top or bottom head of a once through steam generator with one change of position, and capable of reaching the overwhelming majority of tubes without changing position.

It is another object of the present invention to provide an apparatus capable of performing a variety of operations with a variety of tools within a steam generator, and which will withstand the loads required for virtually any tube work performed in a steam generator while being able to locate itself with sufficient precision to carry out detailed work.

A brief description of the invention follows. Operating from outside the manway, a cable is attached to a designated anchor pin in the tubesheet of a recirculating steam generator, or in the bottom head of a once through steam generator, and the vertical support beam, called a mast, is hoisted into position along the cable. A rod, which is not attached to the mast may be used to help guide the mast, which is seated in the tubesheet by locator pins. Alternatively, the top of the mast may be equipped with anchoring fingers that expand to provide a firm grip within the appropriate tubes without damaging the tubes. A pneumatically actuated foot is then adjusted downwardly until it firmly grips the floor of the steam generator head, thereby providing a firmly anchored and supported mast.

The invention also provides an articulating arm for locating appropriate tubes and positioning the tools. The articulating arm is hoisted into position on the mast by means of a cable attached to the mast and may be guided into position with a pole manipulated by a man outside the manway. The articulating arm then locks into position through means of a double V-block coupler or other suitable coupling device, which is reinforced and further locked into coupling position by a pneumatically actuated pin driven into aligned keyways in the male and female member of the coupler, or other suitable coupling means. A computer-controlled locating system then orients the tool carrier of the articulating arm within the steam generator and directs movement of the tool carrier to any designated tube for inspection or repair such as, tube cleaning, tube sleeving, eddy current probing, tube welding, tube plugging, tube profilometry measuring or other tasks.

In the lower head of a once through steam generator, the invention further comprises providing a turntable which is introduced into the steam generator along a cable attached to a locator pin in the same fashion as the mast is installed. The turntable installing apparatus, resembling a jack, is likewise installed and is located on the floor of the head of the steam generator. This apparatus lifts the turntable to the tubesheet, where the turntable is anchored into appropriate tubes. In this case the mast is subsequently introduced into the steam generator along a cable attached to the turntable and is then anchored against the turntable. The articulating arm is then installed in the same way it is installed in the recirculating steam generator. The turntable locks into a position wherein the double V-block coupler of the mast will face the manway for installation of the articulating arm and tools, and then can be rotated 90 degrees of arc in either direction from the initial position thereby providing two working positions 180 degrees apart, thereby permitting access to the 360 degrees of available tubes in the once through steam generator.

In another embodiment designed to operate in the top head of a once through steam generator, the invention provides a stub-mast affixed to a turntable for introduction into the top head. In this case, an installation support pole carrying a cable leans against the inlet piping in the head of the steam generator and has its opposite end detachably connected to the flange of the manway. The cable is attached to the top of the stub-mast and the stub-mast is hoisted along the installation support pole, from which it hangs attached by a block and tackle. When the appropriate position has been reached, the stub-mast is lowered to the tubesheet by means of the block and tackle and anchoring pins anchor the stub-mast to the tubesheet. The top of the stub-mast is not supported. The articulating arm is introduced into the head of the steam generator by means of a block and tackle attached to the installation support pole. It is hoisted along the installation support pole until it is in position adjacent to the stub-mast and then it is lowered by means of the block and tackle into locking engagement with the stub-mast. The two members are coupled by the double V-block coupler, as in the case of the bottom head embodiment. The lower portion of the block and tackle is removed from the articulating arm. The installation apparatus can remain inside the steam generator throughout maintenance work performed by the apparatus, or can be removed, whichever is more convenient.

In either embodiment, the vertical position of the articulating arm is controlled and the articulating arm moves within a V-shaped channel track, which provides close tolerances and high strength. In the embodiment designed for use in the top head of a once through steam generator, having only bottom support requires a somewhat broader base and stiffer mast.

In the embodiment for the top of a once through steam generator, the mast is anchored by anchoring fingers which provide a very firm grip on the inner wall of tubes within the steam generator without damaging the tubes. The anchoring fingers comprise a central shaft having cone-shaped locating nose and a tapered body, said taper providing a smaller diameter near the mounting plate of the mast than near the cone-shaped locating nose, and a threaded end remote from the nose. This central member is encased in an expandable sleeve which illustratively may include a plurality of slots about its circumference to permit easy expansion. After the anchoring fingers have been located in appropriate tubes, a nut runner pulls the threaded central member toward the mast, simultaneously expanding the expandable sleeves to ensure a firm grip on the inside tube wall and pulling the mast toward the tubesheet, thereby securely fastening the mast to the tubesheet.

Embodiments of the apparatus according to the present invention can present the tool carrier to the manway for quickly changing or adjusting tools without the necessity for entering the steam generator. Tools are attached to the tool carrier of the articulating arm by a double V-block coupler or other suitable fastener.

All functions are controlled from outside the steam generator. All movement of the articulating arm and tools is controlled by compressed air operating through air motors, air cylinders, and the like, all controlled by a central pneumatic control box or by electrical motors and sensors. To provide operator feedback, a video camera and light are mounted on the apparatus. The computer control which locates the position of the tool carrier is conventional.

The apparatus of the present invention is capable of automatic location to within less than 0.10" at a 10 pound side load and can be manually positioned to within less than 0.005". Furthermore, in the bottom head of a steam generator, the apparatus can lift a minimum of 100 pounds to the tubesheet and sustain a load of 200 pounds applied at the end of the fully extended articulating arm with less than 0.75" deflection. In addition, the apparatus can operate in an environment of at least 150° F. The apparatus can position tools weighing more than 100 pounds at a speed of 1 rpm with a minimum lateral force of 30 pounds and can traverse steam generator extremes in a maximum of 30 seconds. The apparatus can be remotely controlled and operated by an operator who is at least 500 feet away from the apparatus.

Because the steam generator is radioactive, naturally the apparatus will become radioactive after use. Therefore, particular care was taken during design to ensure that the articulating arm can be disassembled and reassembled simply and readily to permit ease of maintenance. Many maintenance functions, for example, replacement of air motors and locators, can be accomplished in the field in a glove box in half an hour or less.

The invention is more completely and fully described in the detailed description of the preferred embodiments that follows.

DESCRIPTION OF THE PREFERRED EMBODIMENTS

Figure 1:
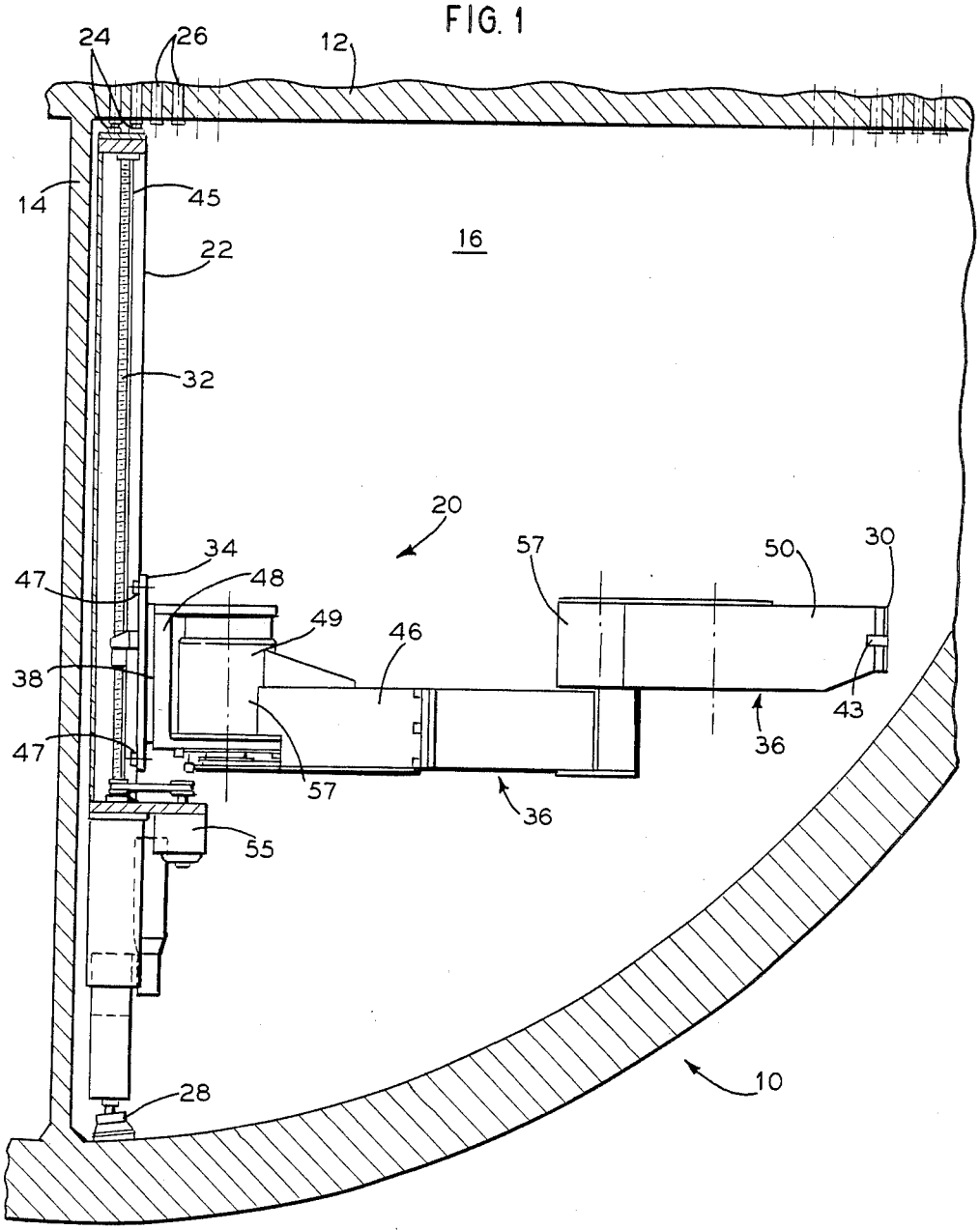
FIG. 1 is a plan view of the apparatus according to the present invention installed in a recirculating steam generator which is illustrated in cutaway cross section.

In referring to FIG. 1, there is depicted a typical recirculating steam generator 10 having a tubesheet 12 and a partition 14 for separating the steam generator head 16 into hotleg and coldleg portions. The apparatus according to the present invention, remote manipulator 20, is installed within head 16 of recirculating steam generator 10. Remote manipulator 20 comprises mast 22 fastened to tubesheet 12 by a plurality of anchoring fingers 24 secured within tubes 26, which in turn are fixed in tubesheet 12. The opposite end of mast 22 includes adjustable foot 28 for securing the bottom of mast 22 to the bottom of head 16 and may be pneumatically actuated. Adjustment of adjustable foot 28 changes the height of mast 22, permitting its use in steam generators of different dimensions. Mast 22, is typically located adjacent and substantially parallel to partition 14 and substantially along the vertical center line of partition 14 to permit access to the maximum number of tubes by tool carrier 30. Mast 22 includes lengthwise screw 32 which carries movable trolley plate 34 for providing controlled vertical movement of articulating arm 36 attached to mast 22 by double V-block coupler shown generally at 38. Articulating arm 36 is operatively mounted to a channel 45 which, in turn, is attached to mast 22. Vertical travel of the articulating arm 36 is controlled by rotation of a lengthwise screw 32 controllably driven by direct current stepper motor 55. Six trolley rollers 47, attached to movable trolley plate 34, ride in channel 45 to provide precise, but easy vertical movement.

Articulating arm 36 includes an inner arm 46 which is pivotally attached to a trolley mounting plate 48. An outer arm 50 is pivotally attached to the end of the inner arm 46 remote from mast 22 and terminates in a tool carrier 30 that has a pneumatic latching pin 43 for attachment of tools. FIG. 1 shows articulating arm 36 in a basically extended position, but the two pivoting joints in the arm permit its controlled movement in two dimensions in such a manner that it can locate itself at any position in a plane in a range of 180 degrees of arc by pivoting either or both pivotal joints independently and in either direction. Inside inner junction box 49 is electrical servo motor 57, having a resolver, for pivoting and controlling inner arm 46. A second servo motor 57 and associated resolver similarly controls rotation of outer arm 50 relative to inner arm 46.

In this basic configuration, remote manipulator 20 can be used in the bottom half of a recirculating steam generator 10, or in the bottom head of a once through steam generator. Certain modifications comprising another preferred embodiment which will be discussed in detail below enable remote manipulator 20 to operate on a 360 degree surface, making it unnecessary to move remote manipulator 20 in order to reach the tubes that would be in the opposite leg of a recirculating steam generator. Yet another modification leads to another preferred embodiment discussed in detail below which permits operation of the basic remote manipulator 20 in the top head of a once through steam generator and also permits operation in 360 degree plane of rotation.

Figure 2:
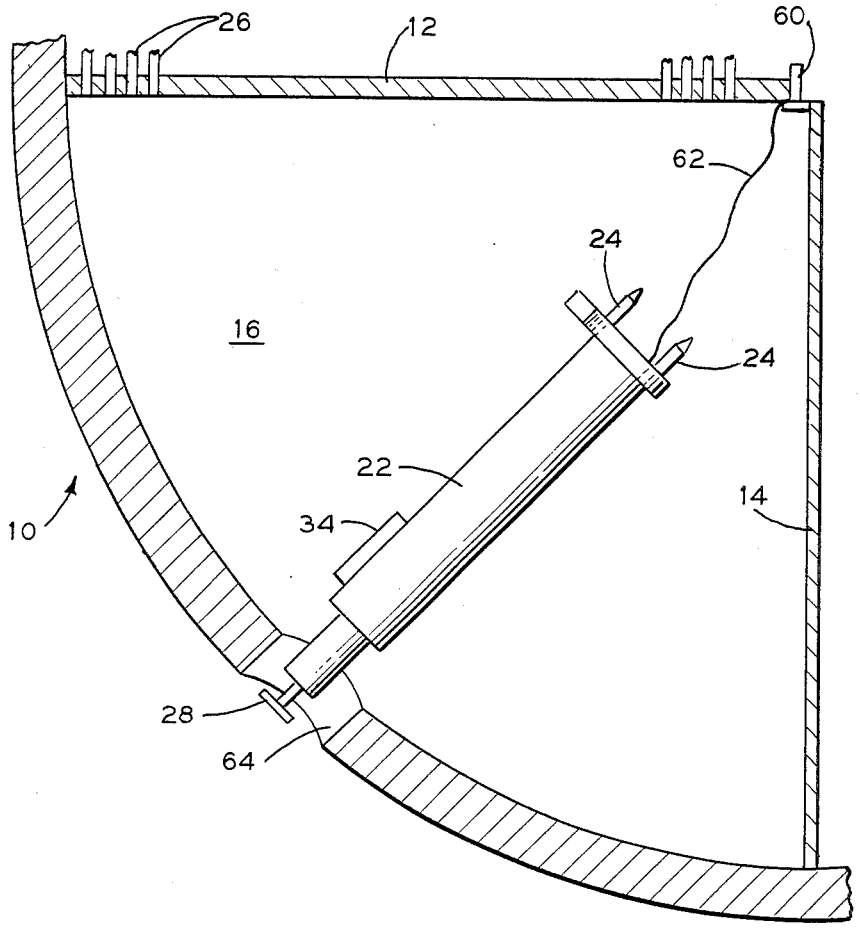
FIG. 2 shows the mast of the invention being installed in a recirculating steam generator.

Referring to FIG. 2, anchor pin 60, having cable 62 fixedly attached thereto, is fastened inside a previously identified tube in tubesheet 12 from outside manway 64. Cable 62 extends outside manway 64 (not shown) where it is attached to mast 22 which is hoisted into position as shown in FIG. 2 along cable 62. Anchoring fingers 24 are aligned with previously identified tubes. The appropriate tubes for seating locator pins in the tube sheet are typically marked in advance with a white paint which resists the harsh environment of a steam generator, as is conventional in the industry. Adjustable foot 28 of the now vertical downwardly hanging mast 22 is pneumatically actuated to lengthen, thereby providing a firm base against the bottom of head 16. Firmly anchored by the compression force at both the top and bottom provided by the extended adjustable foot 28, mast 22 provides a strong, stiff support for articulating arm 36, any tools that may be attached thereto and any forces generated during working operations. A locator pole (not shown) manually held and manipulated by a man outside the manway may be pushed against mast 22 to help align anchoring fingers 24 during installation of mast 22 in tubesheet 12, although this is not strictly necessary.

Figure 3:
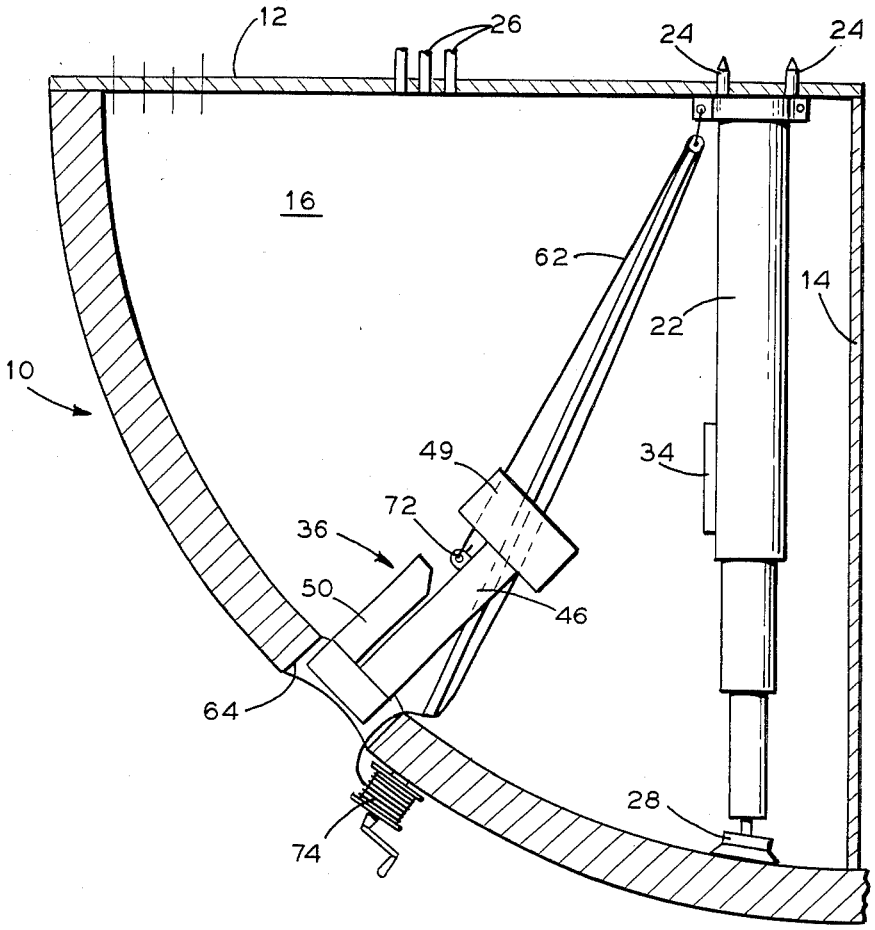
FIG. 3 illustrates installation of the articulating arm following installation of the mast within a recirculating steam generator.

Referring to FIG. 3, pulley cable 62 is attached to mast 22 at one end and attached to cable fastener 72 of articulating arm 36 outside manway 64 at the other end. At cable fastener 72, near the center of gravity of articulating arm 36, pulley cable 62 is introduced into a winch on articulating arm 36, which is then hoisted with pulley cable 62 into position by hand winch 74 removably attached to the manway 64 where it is locked on to mast 22. During installation, articulating arm 36 may be guided by a man reaching his arm through the manway.

Following the operation described in connection with FIGS. 2 and 3, outer arm 50 is rotated away from inner arm 46 to extend the entire articulating arm 36, which is now in the operating position illustrated in FIG. 1. Before operations can be commenced, a tool is attached to tool carrier 30 as shown in FIG. 1. By articulating the two joints of articulating arm 36, and adjusting the height of articulating arm 36, tool carrier 30 may be extended to or beyond the edge of manway 64 to permit ready installation and removal of different tools for performing different tasks. Furthermore, in this position, portions of articulating arm 36 are accessible for maintenance and repair.

Remote manipulator 20 as shown in FIG. 1 is removed from recirculating steam generator 10 by reversing the installation steps described above.

Figure 4:
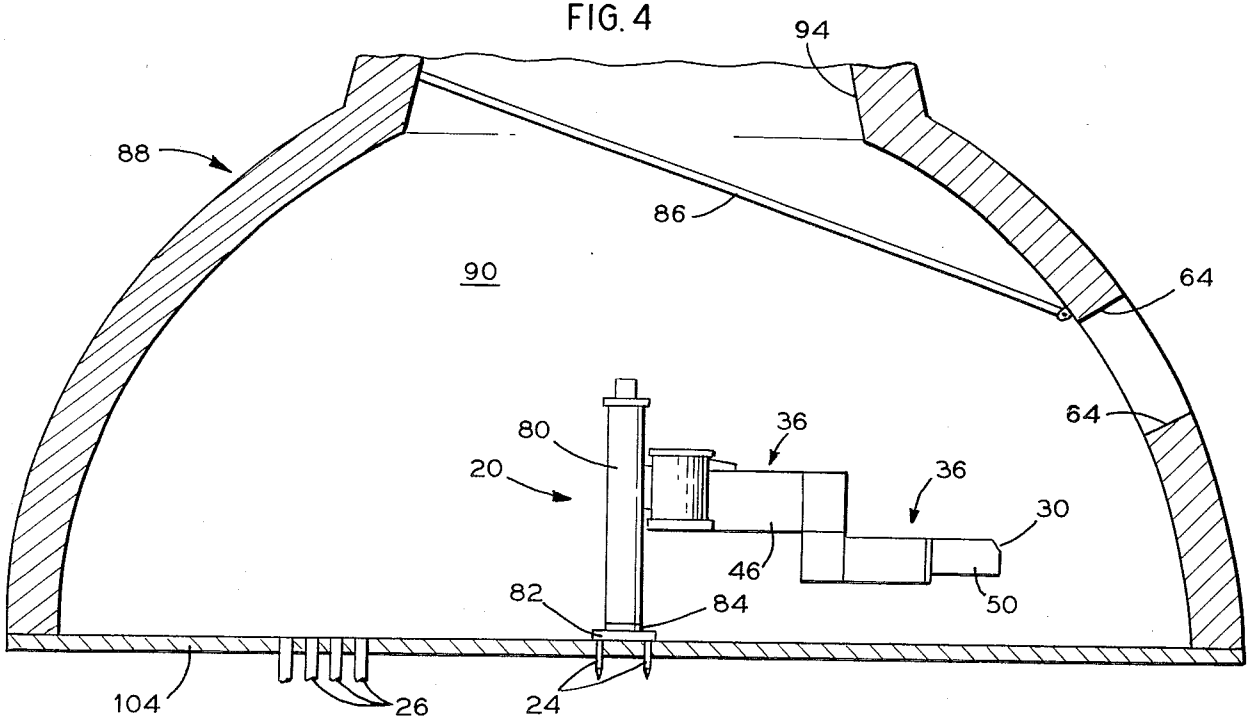
FIG. 4 illustrates the apparatus according to the present invention completely assembled and installed in the top head of a once through steam generator.

FIG. 4 illustrates another preferred embodiment of the apparatus according to the present invention for use in the top head of a once through steam generator comprising stub-mast 80 fastened to tubesheet 104 by anchoring fingers 24. The top of stub-mast 80 is not attached to any support, so that unlike the embodiment described above in connection with the lower head of a steam generator, base 82 of remote manipulator 20 provides the entire support for the system. Articulating arm 36 is attached to stub-mast 80 in a fashion similar to that discussed above, although its position is inverted, that is, outer arm 50 is lower than inner arm 46, the opposite of that relationship in the embodiment discussed above. Naturally, this arrangement permits tool carrier 30 to be moved closer to tubesheet 104 since outer arm 50 can be positioned adjacent to the tubesheet in either embodiment.

Turntable 84, comprising an integral portion of stub-mast 80, rests on base 82 for rotation thereon and stub-mast 80 is fixedly attached to turntable 84. Rotation of turntable 84 is controlled pneumatically and turntable 84 can be locked into any of three positions, an initial position wherein double V-block coupler 38, not shown, on stub-mast 80 faces manway 64 to permit installation of articulating arm 36, and two working positions located 90 degrees on either side of the initial position, permitting remote manipulator 20 to be rotated into either of two working positions 180 degrees of arc apart, permitting articulating arm 36 to operate with 360 degrees of rotation. Tool carrier 30 can thereby reach all tubes within the top head of the once through steam generator, except those tubes located relatively close to base 82, from one position, and can reach all tubes with one change of position of remote manipulator 20. In this embodiment also, tool carrier 30 on the working end of outer arm 50 can be presented at manway 64 for changing tools and performing some maintenance on articulating arm 36. Also illustrated in FIG. 4 is installation support pole 86, used to install remote manipulator 20, and which may be left in position while remote manipulator 20 is being used. Like the embodiment described above, this embodiment can be installed in and removed from the steam generator without having anyone enter the steam generator, although this embodiment is directed only to a remote manipulator for the top head of a once through steam generator.

Figure 5:
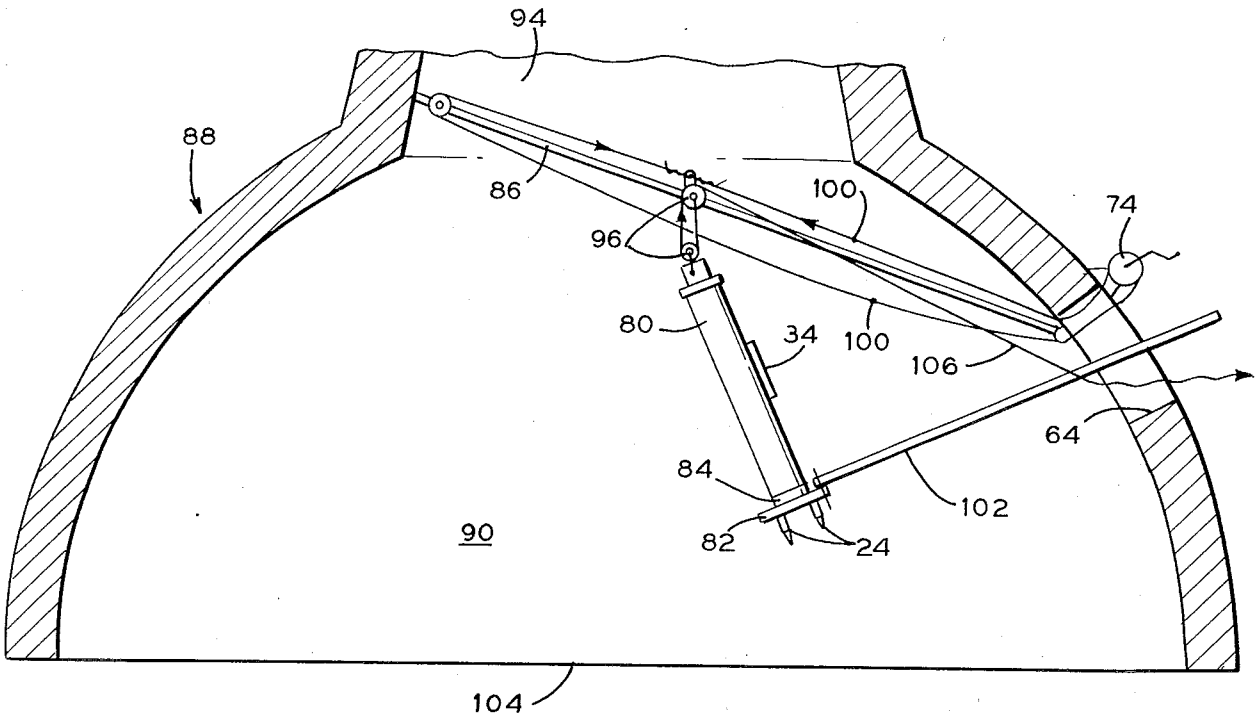
FIG. 5 illustrates installation of a stub-mast through means of the installation support pole and block and tackle in the top head of a once through steam generator.

Referring to FIG. 5, which shows installation of stub-mast 80, installation support pole 86 is manually inserted into top head 90 of once through steam generator 88 by an operator standing outside manway 64, who props the remote end of installation support pole 86 against inlet neck 94 of top head 90 and detachably affixes the proximate end of installation support pole 86 to the inside surface of top head 90 adjacent the top of manway 64. Previously attached to installation support pole 86 is block and tackle 96. The trolley of block and tackle 96 can be prepositioned as desired along pole 86 by operating cable 100 and clamping in place. The lower end of block and tackle 96 is detachably attached to the top of stub-mast 80. By turning ratcheting winch 74, detachably bolted to the outer flange of manway 64, an operator outside manway 64 actuates cable 100 causing block and tackle 96 with attached stub-mast 80 to travel upwardly along installation support pole 86. If desired, guiding pole 102 may be detachably connected to stub-mast 80 desirably at a point on or near base 82, and manipulated by an operator outside the manway to prevent excess swinging of stub-mast 80 during installation and to help align and anchoring fingers 24 with previously marked tubes. This procedure is not strictly necessary, however, since stub-mast 80 tends to hang vertically true. When stub-mast 80 has reached the appropriate point near the midpoint of tubesheet 104, it is lowered to tubesheet 104 by means of block and tackle 96, remotely operated from outside manway 64 by B&T cable 106. Nut runners tighten anchoring fingers 24 into previously identified tubes as described above. The anchoring pins themselves will be described in more detail below.

Figure 6:
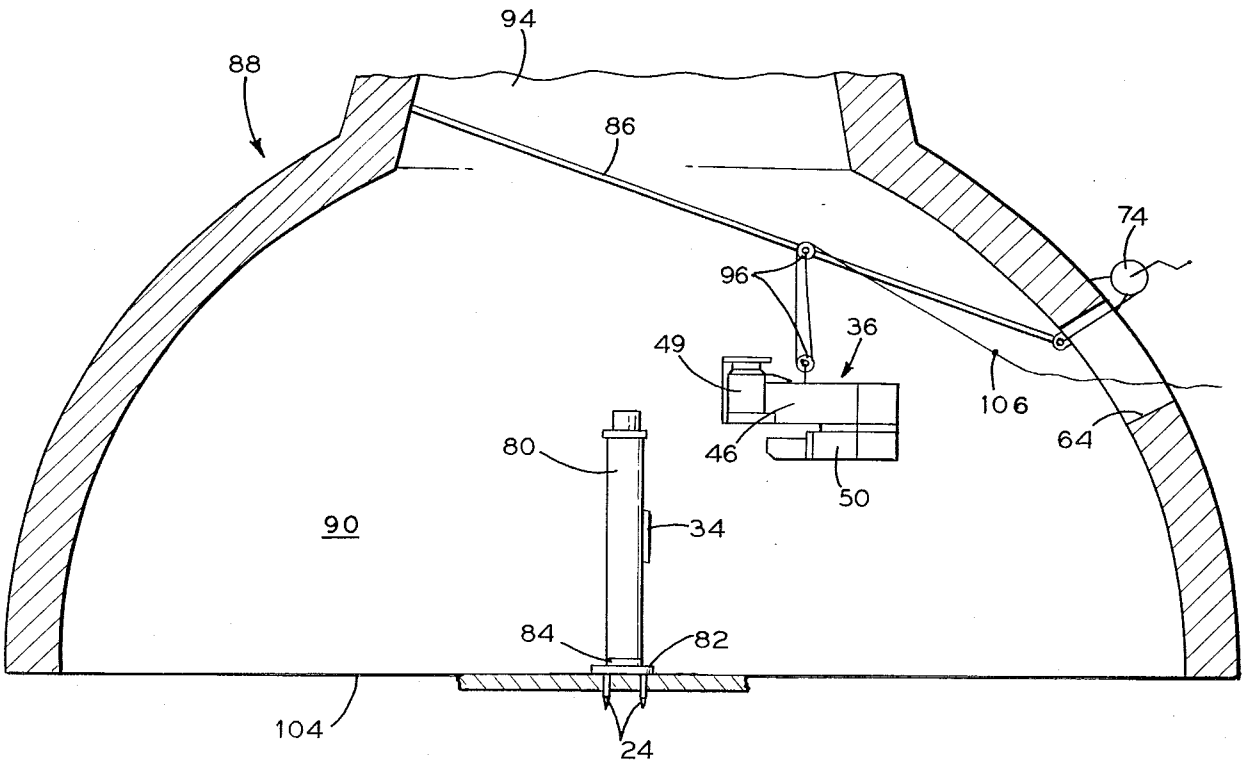
FIG. 6 illustrates installation of the articulating arm of the present invention using the same means, with the mast already mounted in the top head of a once through steam generator.

Referring to FIG. 6, which shows installation of articulating arm 36, block and tackle 96 is detached from the top of stub-mast 80 by a manually operated hooked end cable manipulator, not shown, and returned to its starting position adjacent manway 64, end is attached to articulating arm 36 at a point near the center of gravity of the folded articulating arm 36, so as to maintain articulating arm 36 in a basically horizontal position during installation. Using block and tackle 96 and ratcheting winch 74, articulating arm 36 is moved up installation support pole 86, just as stub-mast 80 was. Articulating arm 36, when in appropriate position is lowered remotely by block and tackle 96 by B&T cable 106, whose remote end is outside manway 64 and may be positioned by a man reaching his arm through the manway 64 the articulating arm 36 is then locked onto mast 80 by a double V-block coupler. Block and tackle 96 is then detached from articulating arm 36 and moved to a position where it will not interfere with the assembled remote manipulator 20 as shown in FIG. 4. Articulating arm 36 is then moved to manway 64 for attachment of tools to tool carrier 30 as shown in FIG. 4. Remote manipulator 20 is then ready to perform its computer-controlled conventional locating operations.

Articulating arm 36 can be moved up and down stub-mast 80 in the manner described above regarding the preceding embodiment. To remove remote manipulator 20 from top head 90 the sequence described above is merely reversed.

Articulating arm 36 may be substantially rectangular tubular members constructed by welding steel plates along their seams. In a preferred embodiment, however, to reduce weight, mast 22, stub-mast 80 and articulating arm 36 are constructed primarily of hardened aluminum, which is anodized to resist environmental degradation. Other members, fasteners, couplers and the like are desirably made of stainless steel to increase strength and reduce corrosion. Pivoting of the joint between mounting block 48 of articulating arm 36 and first arm 46, and between first arm 46 and probe arm 50 may be accomplished by conventional direct current electric stepper motors and other types of electric or air motors, such as servo motors and vertical movement of articulating arm 36 along mast 22 or stub-mast 80 may be similarly achieved. Installation support pole 86 may be aluminum, or steel, or other suitable material which provides sufficient strength and rigidity. Conventional ¼" diameter reinforced tubing provides suitable air delivery means for driving the pneumatic actuators that control remote manipulator 20. Similar tubing is used to control and operate tools that may be attached to tool carrier 30.

Naturally, articulating arm 36 may be permanently connected to mast 22, or in the case of a remote manipulator for the upper head of the once through steam generator, articulating arm 36 may be permanently attached to stub-mast 80, permitting installation of the entire remote manipulator in a single procedure, such as those discussed above in connection with the mast of a two-piece manipulator. Providing a manipulator which can be installed as a single assembly obviously reduces the labor cost and time associated with installation and obviates the necessity for designing a detachable coupling which provides very precise alignment of articulating arm 36 with mast 22, or stub-mast 80. Such a single assembly is particularly attractive when the remote manipulator will be subjected to light or moderate loads, which naturally reduce the required structural strength and permit substantial reductions in manipulator weight.

Figure 7:
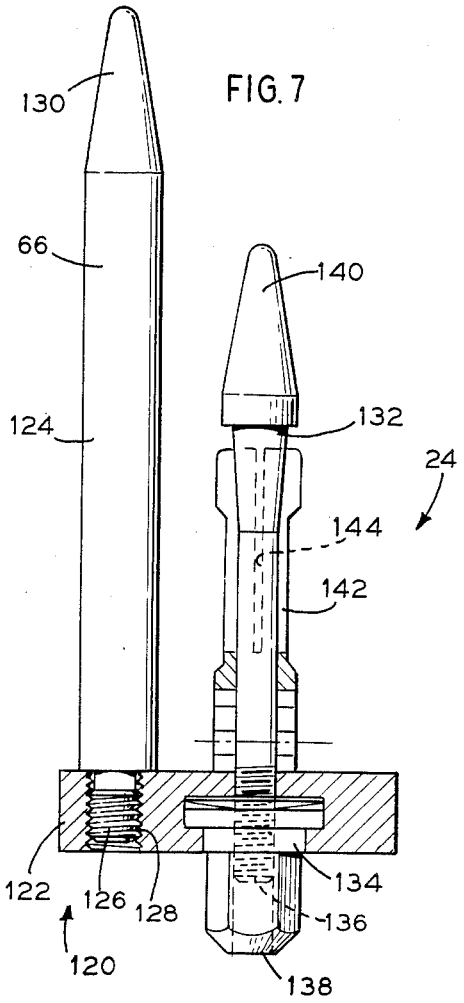
FIG. 7 is a side elevation in partial cross section of a locator pin and anchoring finger assembly.

FIG. 7 illustrates a locator pin and anchoring finger assembly used to secure the mounting plate of stub-mast 80 to tubesheet 104 (FIG. 4). Locator pin and anchoring finger assembly 120 has a mounting block 122 for securing the two longitudinal members, which may naturally form a portion of a larger mounting plate, such as that which forms the base of stub-mast 80. Locator pin 66 includes a substantially cylindrical body 124 having a reduced diameter fitting end 126 secured in aperture 128 of mounting block 122 by threading, press-fitting, welding, or other suitable means. The locating end of locator pin 66 is a cone-shaped nose portion 130. Anchoring finger 24 includes mandrel 132 seated in aperture 134 of mounting block 122 and having a threaded end 136 which penetrates mounting block 122 for mating with nut 138. As oriented in FIG. 7, the diameter of mandrel 132 increases as the shaft goes upwardly. The end of anchoring finger pin 24 remote from nut 138 terminates in cone-shaped nose portion 140. Both noses 130, 140 are designed to permit easy penetration of tubes without being precisely aligned with the center of the tubes and without causing damage to the tubes. Sleeve 142 is seated around the tapered body portion of mandrel 132 above mounting block 122 and includes a plurality of longitudinal slots 144 in the upper portion of sleeve 142 providing sleeve 142 with circumferential flexibility. Locator pin 66 is longer than anchoring finger 24. Locator pin 66 may have a diameter somewhat smaller than the inside diameter of the tubes into which it will be inserted. In the configuration illustrated in FIG. 7, the assembly is used for installing mast 22 into the head of a recirculating steam generator, as illustrated in FIG. 2 and described above; and for installing the base and turntable in the top head of a once through steam generator.

Figure 8:
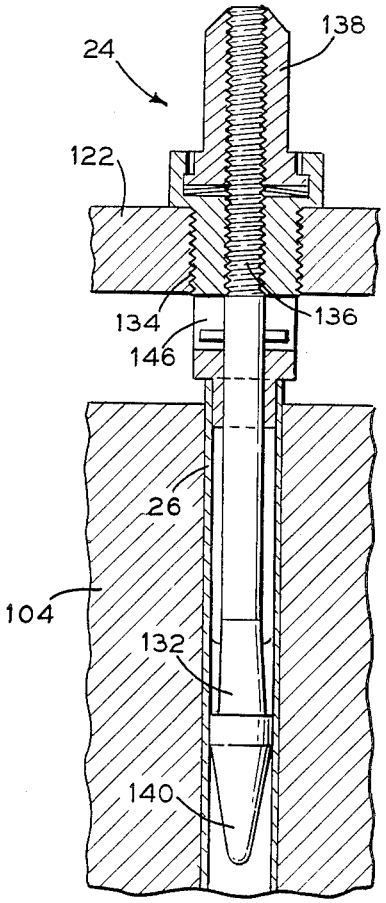
FIG. 8 is a side elevation in partial cross section of an anchoring finger installed in a tube of a steam generator at the tubesheet.

In operation, locator pin 66, and thereby any apparatus connected to it through mounting block 122, is positioned so that the small end of nose portion 130 is within the side wall of the inside of a tube and mounting block 122 is then moved upwardly as illustrated in FIG. 7, so that locator pin 66 is inserted into the appropriate tube until the top surface of mounting block 122 is adjacent the tube sheet. Anchoring finger 24 will naturally also be seated almost entirely within a tube. Tightening nut 138 draws mandrel 132 downwardly, causing the circumference of sleeve 142 to swell thereby pushing sleeve 142 against the inside side wall of the tube. The tighter nut 138 is tightened, the greater is the force exerted against the side wall of the tube. Simultaneously, mounting block 122 is drawn against the tubesheet. Thus, anchoring finger 24 provides a fastener which acts much like a bolt and nut. The metal-to-metal contact permits application of substantial force against the inside of the tube without destruction of soft materials, for example, rubber, which have been used in the past to prevent damage to the tubes. In addition, anchoring finger 24 will not damage the tube. FIG. 8 illustrates anchoring finger 24 installed in a tube adjacent a tubesheet.

In another preferred embodiment illustrated in FIG. 8, anchoring finger 24 includes shoulder portion 146 extending downwardly beyond mounting block 122 and having a diameter larger than the diameter of the tube. Shoulder portion 146 seats against tube 26 as shown in FIG. 4 and mounting block 122 is spaced away from tubesheet 104. This embodiment of anchoring finger 24 is used to secure stub-mast 80 to clear tube plugs or other obstructions protruding from tubesheet 104. This clearance is not necessary in the case of the locator pin 66 and anchoring finger 24 assembly as used in FIG. 2 because mounting block 122 occupies a much smaller surface area than the base of stub-mast 80.

While various useful embodiments of the invention have been described in detail above, various modifications and alterations may occur to those skilled in the art that are within the spirit and scope of the invention. Therefore, the scope invention should be measured by the claims that follow.

We claim:

1. A remote manipulator for use in connection with tubes disposed within a tubesheet within the head of a nuclear steam generator, comprising;

an elongated mast having a longitudinal axis and opposite ends;

cable fastening means connected to one of the opposite ends of the mast;

winch means including a cable operatively connectable to the cable fastening means for hoisting the mast into the head of a nuclear steam generator;

a turntable fixed to one of the opposite ends of the mast;

a mast base rotatably mounted to the turntable;

at least one locator pin fixed to and extending from the mast base for insertion into a tube of a tubesheet to locate the mast base at a selected position with respect to the tubesheet;

at least one anchoring finger connected to and extending from the mast base for insertion into another tube of the tubesheet for anchoring the mast base to the tubesheet at the selected position;

a lengthwise screw mounted to the mast, the lengthwise screw having a longitudinal axis extending parallel to the longitudinal axis of the mast, the screw being rotatable about its longitudinal axis;

carrier means engaged to the screw for lengthwise movement along the mast in response to rotation of the screw;

means for rotating the screw;

a trolley plate mounted to the carrier means for lengthwise movement of the trolley plate relative to the mast with movement of the carrier means;

an articulating arm;

a pneumatic coupler for detachably locking the articulating arm onto the trolley plate for lengthwise movement with the trolley plate;

the articulating arm comprising an inner arm pivotally mounted to the trolley plate about an axis extending substantially parallel to and spaced laterally from the longitudinal axis of the mast, and an outer arm pivotally mounted to the inner arm about an axis extending substantially parallel to and spaced laterally from the longitudinal axis of the mast;

a pneumatic latch for detachably connecting tools to the outer arm of the articulating arm;

means for pivoting the inner arm with respect to the trolley plate;

means for pivoting the outer arm with respect to the inner arm; and means for governing the position of the inner and outer arms with respect to the mast and the trolley plate with respect to the mast so that the tools are capable of reaching all of the tubes in the tubesheet and so that the tools are movable in a rectilinear pattern in a direction lengthwise of the mast and radially of the mast.

2. A remote manipulator according to claim 1, including a cable fastener connected to the articulating arm near the center of gravity of the articulating arm, the cable of the winch means being connectable to the cable fastener of the articulating arm for hoisting the articulating arm into the head of the nuclear steam generator and to a location near the mast for locking the articulating arm to the trolley plate.

3. A remote manipulator according to claim 2, wherein the turntable includes positioning means for positioning the mast at three rotational positions with respect to the mast base, the three rotational positions including a central position for connecting the articulating arm to the mast and two positions which are 90° from the central position and on opposite sides of the central position, so that the articulating arm can reach substantially all tubes of the tubesheet.

4. A remote manipulator according to claim 3, wherein the anchoring finger comprises a mandrel extending into the mast base, a nut threadably mounted to one end of the mandrel, the mandrel having an opposite end with a cone-shaped portion and an expandable sleeve engaged over the mandrel, whereby rotation of the nut draws the cone-shaped portion deeper into the expandable sleeve for expanding the sleeve, the expandable sleeve being insertable into a tube of the tubesheet and being expandable in the tube of the tubesheet for locking the mast base to the tubesheet.

5. A remote manipulator according to claim 4, wherein each of the locator pin and the anchoring finger include a tapered nose at an end thereof spaced away from the mast base, the locator pin being longer than the anchoring finger.

6. A remote manipulator according to claim 1, wherein the anchoring finger comprises a mandrel extending into the mast base, a nut threadably mounted to one end of the mandrel, the mandrel having an opposite end with a cone-shaped portion and an expandable sleeve engaged over the mandrel, whereby rotation of the nut draws the cone-shaped portion deeper into the expandable sleeve for expanding the sleeve, the expandable sleeve being insertable into a tube of the tubesheet and being expandable in the tube of the tubesheet for locking the mast base to the tubesheet.

* * * * *